United States Patent [19]

Niemirow

[11] 4,165,729

[45] Aug. 28, 1979

[54] ELASTIC TYPE PROJECTING DEVICE

[76] Inventor: Jerzy Niemirow, 3 Beaufort Ave., Dover, N.J. 07801

[21] Appl. No.: 811,548

[22] Filed: Jun. 30, 1977

[51] Int. Cl.[2] ..... F41B 7/00

[52] U.S. Cl. ..... 124/17; 124/41 R; 124/31

[58] Field of Search ..... 124/21, 27, 35 R, 41 R, 124/37, 83, 17

[56] References Cited

U.S. PATENT DOCUMENTS

| | | | |
|---|---|---|---|
| 47,815 | 5/1865 | Hall | 124/21 |
| 61,419 | 1/1867 | Hall | 124/21 |
| 1,571,643 | 2/1926 | Renick | 124/21 |
| 3,119,385 | 1/1964 | Ashley | 124/21 X |
| 3,656,252 | 4/1972 | Sherman | 124/35 R UX |
| 3,774,585 | 11/1973 | Boyd | 124/21 |

FOREIGN PATENT DOCUMENTS

| | | | |
|---|---|---|---|
| 1076306 | 4/1954 | France | 124/21 |
| 447613 | 4/1949 | Italy | 124/27 |

*Primary Examiner*—Richard C. Pinkham
*Assistant Examiner*—William R. Browne

[57] ABSTRACT

A launcher is described having a tubular body containing therewithin a plurality of headers and pistons, and wherein spaced elastic bands communicating therebetween are caused to be placed in a high degree of tension through a bidirectional ratchet mechanism to controllably propel an object placed in a cup forward said tubular body when a trigger is actuated to release stored energy in the tension bands.

15 Claims, 6 Drawing Figures

ELASTIC TYPE PROJECTING DEVICE

The launcher concerns a quiet, lightweight, economical, accurate and reliable device for launching objects over extended distances.

The launcher has a tubular body with a mechanism for elongating elastic members which are used to retract a piston to which is connected a projectile supporting member.

It is a principal object of this invention to provide an improved device, capable of launching objects accurately and readily to a designated target at distances approaching 300 or more feet.

Another object of this invention is to provide such a device which is inexpensive, reliable, and economically assembled.

Still another object of this invention is to provide such a device which is completely portable to women and children.

The exact nature of the invention as well other objects and advantages thereof will become apparant from consideration of the following specifications relating to the attached drawings wherein.

Figure 1:
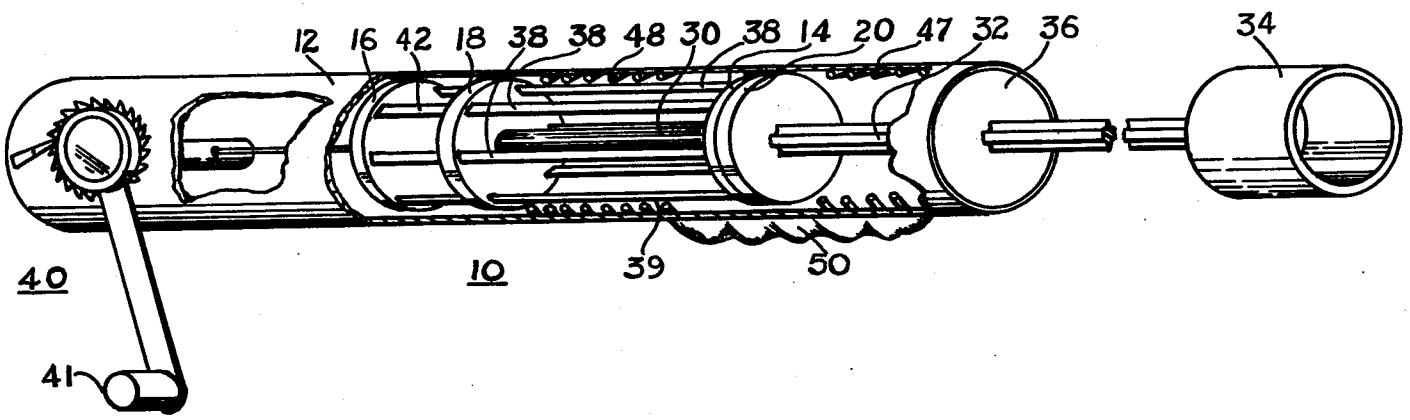
FIG. 1 is a partially cutaway perspective view of an embodiment of my invention.
Figure 2:
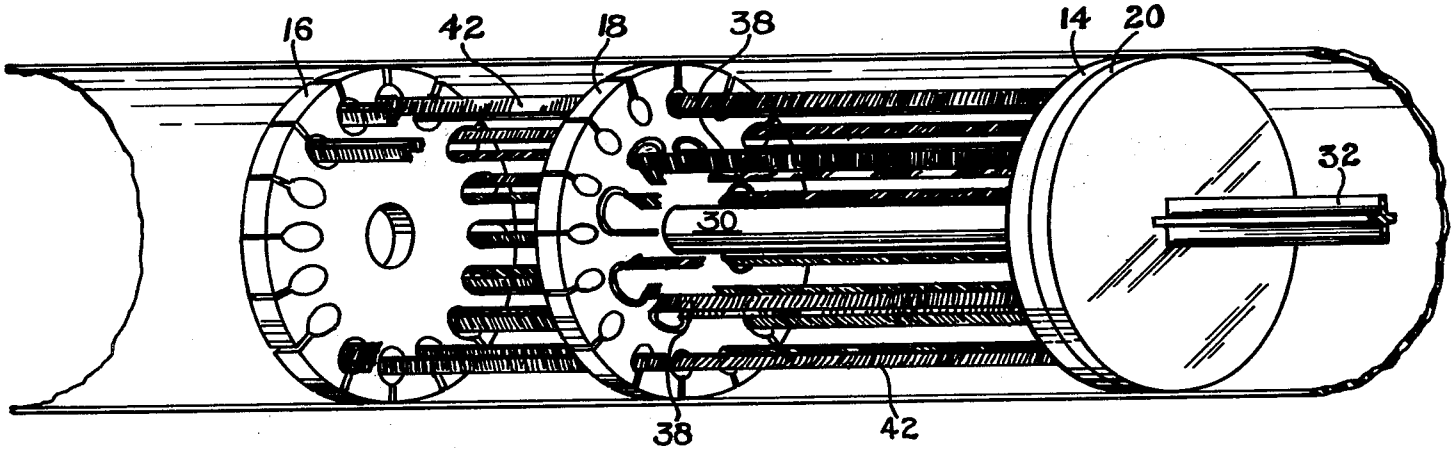
FIG. 2 is a perspective view of a portion of the embodiment shown in FIG. 1, and includes the tension bands and headers and piston assembly associated therewith.

Referring now to the drawings and more particularly to FIG. 1 thereof, my launcher 10 comprises a tube body 12 suitably of aluminum or plastic or other strong lightweight material, said body containing therewithin a fixed header 14, fixedly secured to body 12 by means well known, and a pair of spaced cooperating, movable pistons 16 and 18 disposed rearwardly the fixed header 14, while another movable piston 20 is placed immediately forward the fixed header. A rod 30 communicates between header 14 and piston 18 and a fluted rod 32 articulates between rod 30 and launching cup 34 through a sealed header 36. A plurality of elastic tension bands, 38 (FIG. 2) are secured between header 14 and piston 18, the bands supplying the propulsive force necessary to propel an object placed in launching cup 34 by means of a ratchet mechanism 40 (FIG. 4) through ratchet handle 41, to be described more fully hereinafter. A pair of additional elastic bands 42 are secured to fixed header 14 and piston 16, and through piston 18 as shown in FIGS. 2 and 5, to insure the return of header 16 to its forwardmost position, described hereinafter.

Upon the launching of an object, release of energy stored in bands 38 and 42 maintained in a desired degree of tension by the ratchet mechanism, causes piston 16 and 18 to move forwardly suddenly, the object in the cup 34 being propelled outwardly through forward motion of fluted rod 32. Spring 47 serves to bring piston 20 to its original position forwardly of 14. Spring 48 serves to return piston 18 to its original position. A convenient handgrip 50 is disposed at a forward portion of body 12.

Figure 3:
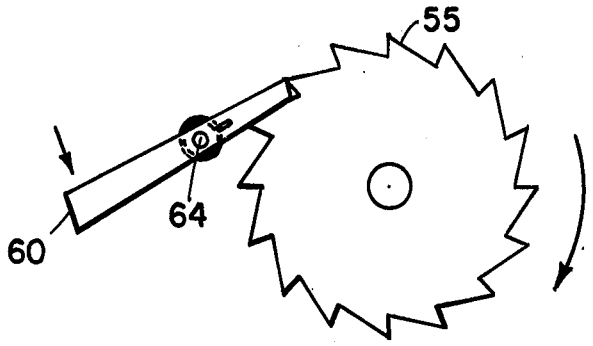
FIG. 3 is a diagrammatic view of the pawl and ratchet mechanism shown in FIG. 1.
Figure 4:
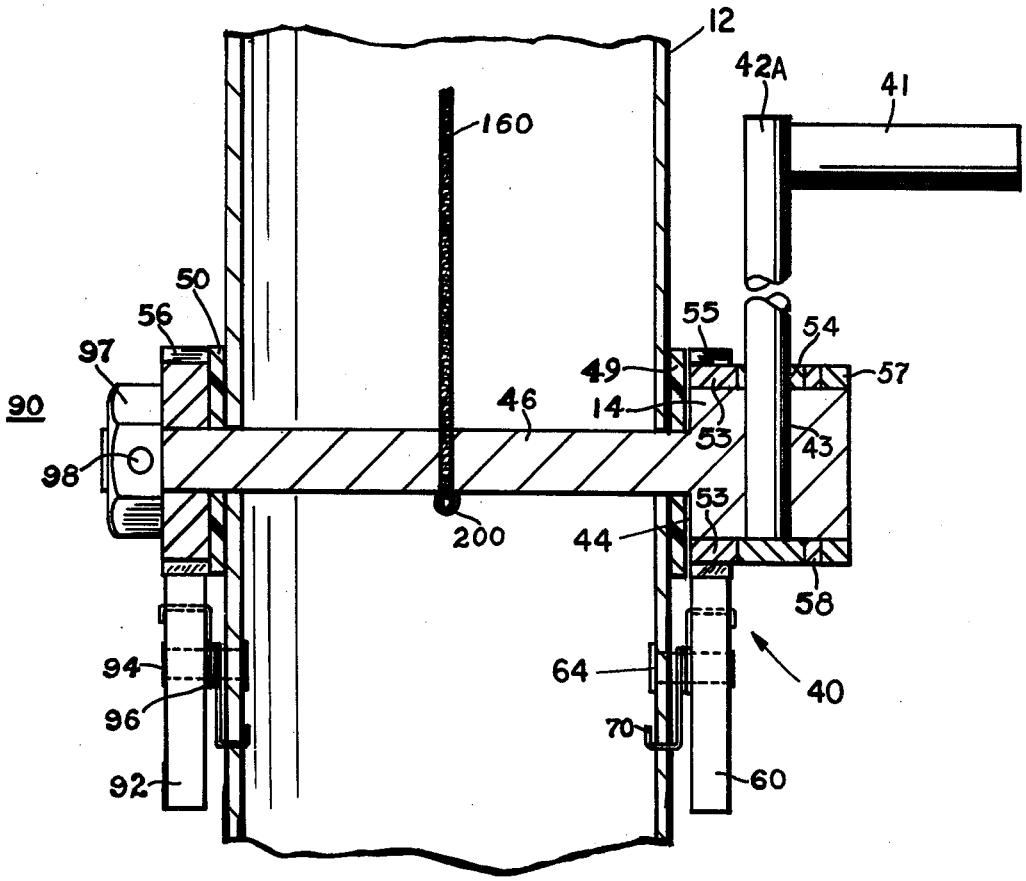
FIG. 4 is a sectional view of the pawl and ratchet mechanism of FIG. 1.
Figure 5:
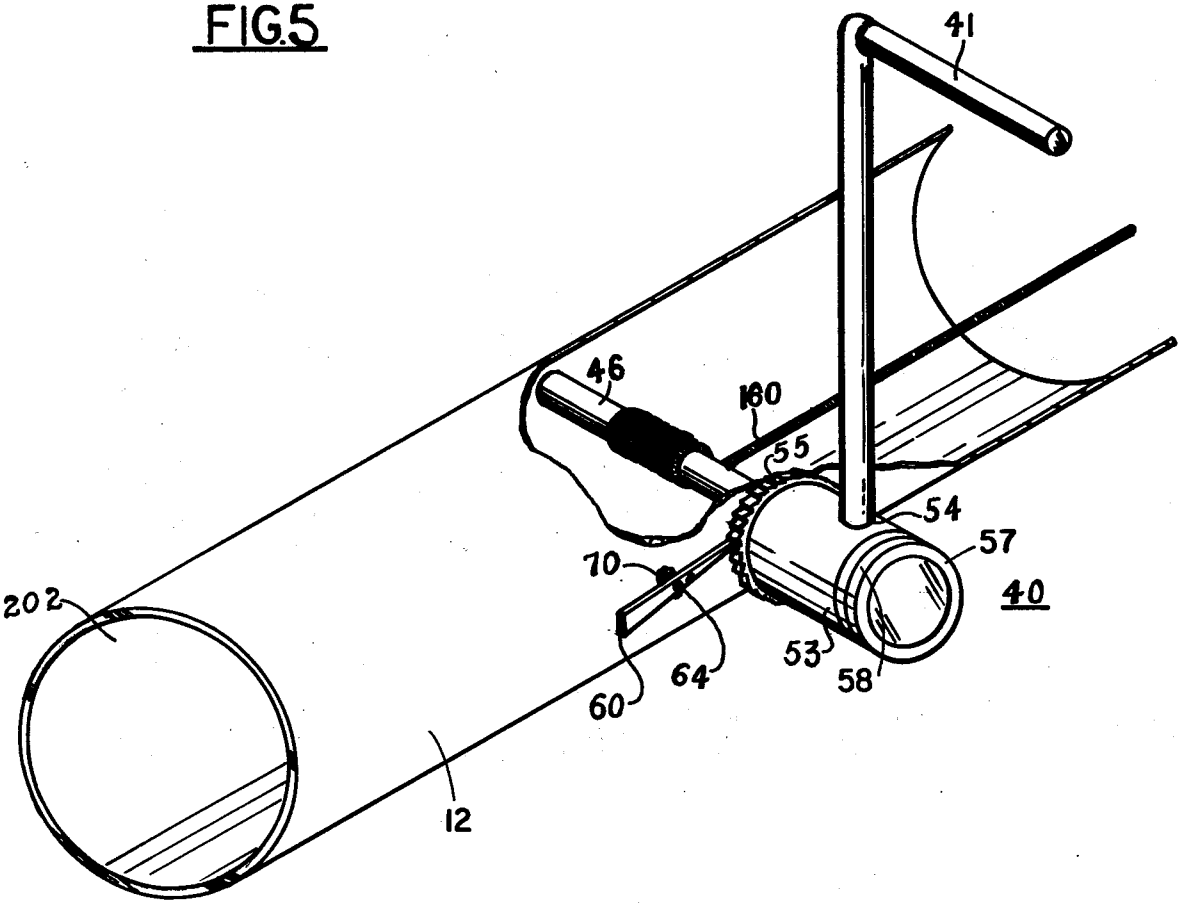
FIGS. 5 and 6 are cutaway perspective views of cooperating mechanism for placing the tension bands of FIG. 1 in tension.

Referring now to FIGS. 3, 4 and 5 of the drawings, the ratchet mechanism 40 comprises ratchet handle 41 which is readily removable from recess 43 in shoulder portion 44 of shaft 46, the shaft extending through body 12 rotatably mounted therein by means well known.

Shoulder portion 44 abuts a plastic washer 49 disposed externally body 12. A similar washer 50 is disposed on the other side of body 12. Cylinder or tube 53 is mounted around shoulder portion 44 and includes orifice 54 for receiving the handle mechanism which may readily be aligned into recess 43 and orifice 54 by simply rotating tube 53 until alignment therebetween occurs. Fixedly attached about tube 53 at its inner portion is gear ratchet 55. Another ratchet 56 is fixedly secured to shaft 46 at the other side of body 12 as shown, its function to be described more fully hereinafter.

Retaining ring 57 is secured to the outer portions of shoulder 44 which maintains tube 53 in abutting relation to washer 49. A plastic washer 58 may be disposed between tube 53 and ring 57. A pawl 60 is caused to slide over gear ratchet 55 when handle 41 is rotated in a clockwise direction, the pawl 60 being pivotally mounted to body 12 at 64. The pawl is urged in engaging relationship to gear ratchet 55 by means of a spring 70. For purposes of safety it is apparent that gear ratchet 55 cannot rotate in a counter clockwise direction due to pawl 60 operably engaging the teeth of gear ratchet 55. A ratchet release mechanism 90 comprises release pawl 92 which is pivotally mounted to body 12 at 94. Spring 96 is disposed against body 12 to urge the release pawl into contacting relationship with gear ratchet 56. Any suitable locking means for maintaining shaft 46 in its operable position may be used, such for example as nut 97 including key 98 or, cotter pin means etc,. . . .

When it is desired to propel cup 34 forwardly, a slight force applied to pawl 92 causes disengagement of the pawl from the teeth of gear ratchet 56. Rotation of handle 41 causes a flexible cable 160 to wrap around shaft 46 resulting in caliper 164 (FIG. 6) of clamping device 166 engaging hole 168 of horizontal member 170, suitably of aluminum or plastic, fixedly secured to piston 18. Clamping device 166 is pivotally mounted at 172, to slidable plate 174 which is secured to piston 16. Central hole 176 in piston 16 permits articulation of wire 160 to clamping mechanism 166 at caliper ends 178, the wire 160 being bifurcated at 180. When a force is applied to wire 160 from a rearward direction, i.e. when handle 41 is rotated in a clockwise direction, caliber 164 will engage horizontal member 170 at hole 168 overcoming the force of the compression spring 181 which normally maintains the calipers disengaged from hole 168. Thus, by merely cranking handle 41 in a clockwise direction, calipers 164 will engage hole 168 to thus cause piston 18 to move rearwardly and to increase tension in the bands 38 and 42. Piston 16 will be caused to move rearwardly since horizontal support member 170 abuts slidable plate 174 which is fixed to piston 16. When ratchet release mechanism 90 is actuated by depressing pawl 92, piston 18 will be suddenly propelled forwardly and cup 34 will be similarly and violently propelled forwardly together with any object contained therewithin. Of course, it will be understood, handle 41 will be removed prior to any disengagement of the release mechanism. It is apparent that pistons 16 and 18, when in the retracted position, i.e. when bands 38 and 42 are caused to be placed in tension, the rearward portion of the fluted rod 32 will partially occupy the space between header 14 and piston 18. Header 14 and piston 20, as well as seal 36, have their apertures configured to receive the fluted portions of the fluted rod 32. Movable pistons 16 and 18, of course, will travel substantially as a pair.

Figure 6:
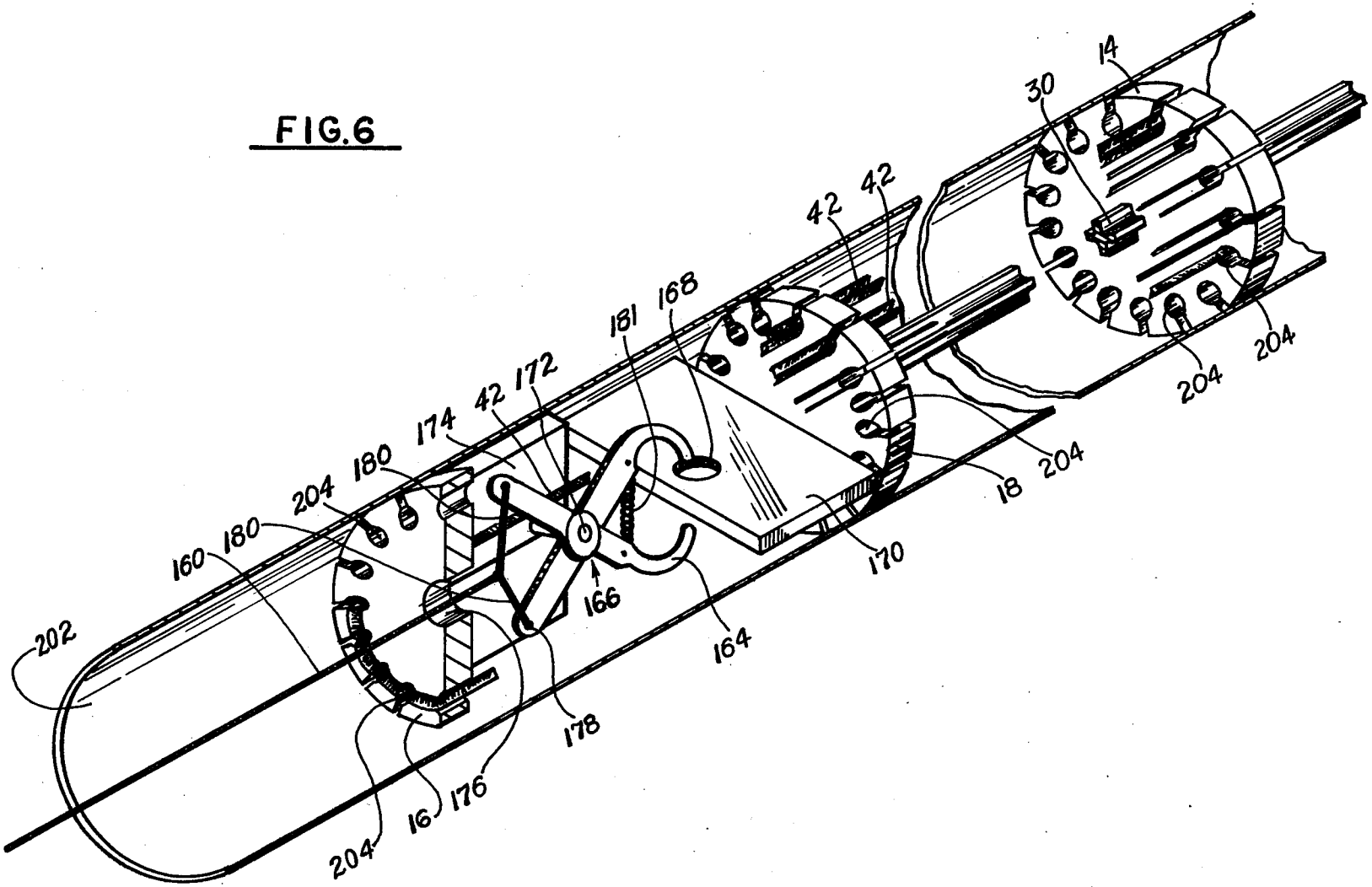

Headers and pistons 14, 16, and 18 are identically configured as shown in FIG. 6, and comprise a plurality of spaced slotted openings 204 at their peripheral portions. Tension bands 38 articulate between header 14 and piston 18, each band comprising a closed elongated loop stretching therebetween. The bands are readily placed into operable position by merely hooking the band around two successive openings 204 of one header or piston and similarly connecting it to the successive openings of the other header or piston such that all bands will be aligned substantially parallel. However, between header 14 and piston 16, only a pair of bands 42 (FIG. 1) diametrically opposed, is sufficient.

In assembling any launching device, rod 30 will be fixedly secured to piston 18. Horizontal member 170 will then be attached to piston 18 as shown in FIG. 6, and the remainder of the clamping mechanism assembled as shown. Spring 48 (FIG. 1) may now be placed in position and header 14 and piston 20 positioned on rod 30 and fluted rod 32 respectively. Tension bands 38 will now be placed around header 14 and piston 18 as aforedescribed and additional tension bands 42 attached to piston 16 and header 14, as shown in FIG. 2. The assembly thus described may now be inserted into the tubular body 12. Header 14 will be secured to the tubular body by screw means or the like, as will fixed header 36 (FIG. 1). Cup 34 may be threadedly mounted to fluted rod 32. Cable 160 is readily attached to ring 200, (FIG. 4) of shaft 46 by means of the fingers through the rear open end 202 (FIG. 5) of tubular body 12, the ratchet and pawl mechanism having been placed into position prior thereto. Of course, end 202 may optionally be sealed by suitable means if the device is intended to be used in a polluted environment.

I claim:

1. A launcher for propelling objects over extended distances comprising a tubular body, a plurality of movable pistons and fixed headers disposed within said tubular body, said pistons including a first movable piston, and a second movable piston, a first fixed header disposed forwardly said first and second movable pistons, elastic means communicating between said first header and said first and second movable pistons, a third movable piston disposed forwardly said first fixed header, and a second fixed header sealing a forwardmost portion of said tubular body, a launching cup disposed axially exteriorly forwardly of said tubular body, a rod having one end connected to said launcher cup and the other end fixed to said second movable piston, means for placing said elastic means into tension and additional means for releasing energy stored within said elastic bands whereby said first and second movable pistons are propelled violently forwardly with said rod to cause the launching cup to propel outwardly an object placed therewithin, said means for placing said elastic means into tension comprising a shaft disposed rearwardly said first movable piston and longitudinally said tubular body, crank means for rotating said shaft, clamping means disposed between said first and second movable pistons, said clamping means comprising a horizontal member rearwardly affixed to said second movable piston, a slidable plate forwardly affixed to said first movable piston, said horizontal member having a hole therein, and a clamping device adapted for engaging said horizontal member through said hole.

2. The launcher of claim 1, wherein said elastic means comprises a plurality of bands spaced uniformly about a rearward face of said first fixed header and connected thereto, said bands correspondingly connected to a forward face of said second movable piston and another plurality of bands connected correspondingly between said first fixed header and said first movable piston and passing through said second movable piston.

3. The launcher as described in claim 2, wherein said another plurality of bands causes said first movable piston to return to its operable position wherein said slidable plate is caused to abut said horizontal member.

4. The launcher of claim 1, wherein said rod comprises a fluted portion at its forward end and a cylindrical portion at its rearward end such that when said cup is being launched forwardly, said rearward cylindrical portion of said rod is caused to abut said third movable piston to push it forwardly along with said fluted rod and launching cup.

5. The launcher of claim 1, wherein a compression spring is disposed between said third movable piston and said second fixed header, whereby air contained therebetween is caused to be compressed upon launching to decelerate forward motion of said rod and cup and said spring causes said third movable piston to be returned to its operable position.

6. The launcher of claim 1, wherein a compression spring is disposed between said second movable piston and said first fixed header whereby air contained therebetween is caused to be compressed upon launching to decelerate forward motion of said rod, cup, and second movable piston, and said spring causes said second movable piston, rod and cup to be returned to its operable position.

7. The clamping means of claim 1, wherein said clamping means is pivotally mounted to said slidable plate and comprises a pair of calipers having rearward portions for receiving flexible wire means, said calipers being adapted to engage said hole in said horizontal member when said flexible wire means is caused to retract said clamping device.

8. The clamping means of claim 1, further comprising a flexible wire means, said wire means having one end secured to said shaft and rotatable therearound upon rotation of said crank means.

9. The device of claim 1, wherein said shaft includes a shoulder portion disposed exteriorly of said tubular body, a tube slidably mounted about said shoulder portion, said crank means including a cranking rod, an orifice disposed in said tube and a recess disposed in said shoulder portion, said orifice and said recess adapted to receive said cranking rod for rotation of said shaft.

10. The device of claim 1 further characterized by a washer disposed between said tubular body and shoulder portion and in abutting relation to each.

11. The device of claim 10, wherein a ring is rigidly mounted about an outer portion of said shoulder portion for maintaining said tube in an operable position.

12. The device of claim 10 including a first ratchet and pawl assembly, said assembly comprising a gear ratchet fixedly mounted externally an inner portion of said tube, a pawl pivotally mounted to said tubular body, a spring disposed between said pawl and tubular body for urging said pawl into engaging relationship with said gear ratchet whereby said shaft is permitted to rotate in one direction only.

13. The device of claim 12 including a second ratchet and pawl assembly disposed exteriorly said tubular body in opposing and cooperating relationship to said first ratchet and pawl assembly, said second ratchet and pawl assembly comprising a second gear ratchet fixedly secured to said shaft at an end opposite said shoulder portion, a second pawl pivotally mounted to said tubular body, a spring disposed between said second pawl and tubular body for urging said second pawl into engaging rotation with said second gear ratchet whereby upon removable of said cranking rod, after being rotated to place tension in said elastic tension bands, from said first ratchet and pawl assembly and disengagement of said second pawl from said second ratchet and pawl assembly, said shaft is permitted to rotate freely to release a pair of calipers from said horizontal member, and said rod and launching cup are propelled violently forwardly to launch objects placed therewithin over extended distances.

14. The device of claim 13 further characterized by means maintaining said shaft in an operable position.

15. The clamping device of claim 13 further characterized by a compression spring cooperating with said pair of calipers for maintaining said calipers in disengaging relation to said hole when said calipers are not caused to engage said hole during retraction of said clamping device.

* * * * *